United States Patent [19]

Rhodes

[11] Patent Number: 4,488,491

[45] Date of Patent: Dec. 18, 1984

[54] AREA MULTIPLIER

[75] Inventor: Richard R. Rhodes, Stroudsburg, Pa.

[73] Assignee: The United States of America as represented by the Secretary of the Army, Washington, D.C.

[21] Appl. No.: 480,442

[22] Filed: Mar. 30, 1983

[51] Int. Cl.[3] ..... F42B 13/16

[52] U.S. Cl. ..... 102/522; 102/501; 102/514

[58] Field of Search ..... 102/520–529, 102/430; 411/160–164, 441

[56] References Cited

U.S. PATENT DOCUMENTS

| | | | |
|---|---|---|---|
| 472,413 | 4/1892 | Wallis | 411/162 |
| 1,612,955 | 1/1927 | Valberg | 411/160 |
| 4,148,259 | 4/1979 | Yuhash et al. | 102/522 |

FOREIGN PATENT DOCUMENTS

| | | | |
|---|---|---|---|
| 808307 | 7/1951 | Fed. Rep. of Germany | 411/163 |
| 529769 | 12/1921 | France | 411/162 |

*Primary Examiner*—Stephen C. Bentley
*Assistant Examiner*—Tyrone Davis
*Attorney, Agent, or Firm*—Anthony T. Lane; Robert P. Gibson; Edward F. Costigan

[57] ABSTRACT

The invention is an improved area multiplier for use in munitions launching saboted sub-caliber projectiles. The improved area multiplier not only provides the increased area required to reduce sabot base stresses to acceptable levels, but it has a novel and unique structure that improves and assures uniform spin to the projectile. The area multiplier consists of a disc-like portion having a centrally located aperture therein, and a plurality of triangular-like projections affixed to one face of the disc-like portion. The areas between the triangular-like projections serve to lock the area multiplier to the sabot after molding and the sharp edges of and at the apex of the triangular-like projections serve to engage the projectile base during launch to prevent slippage within the sabot and thereby impart a uniform spin to the projectile upon launching.

4 Claims, 5 Drawing Figures

FIG. 1
PRIOR ART
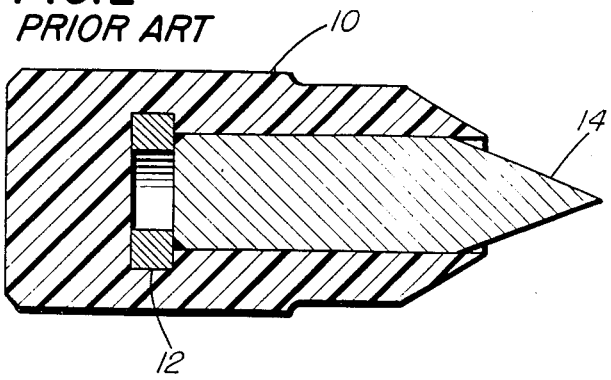
FIG. 2
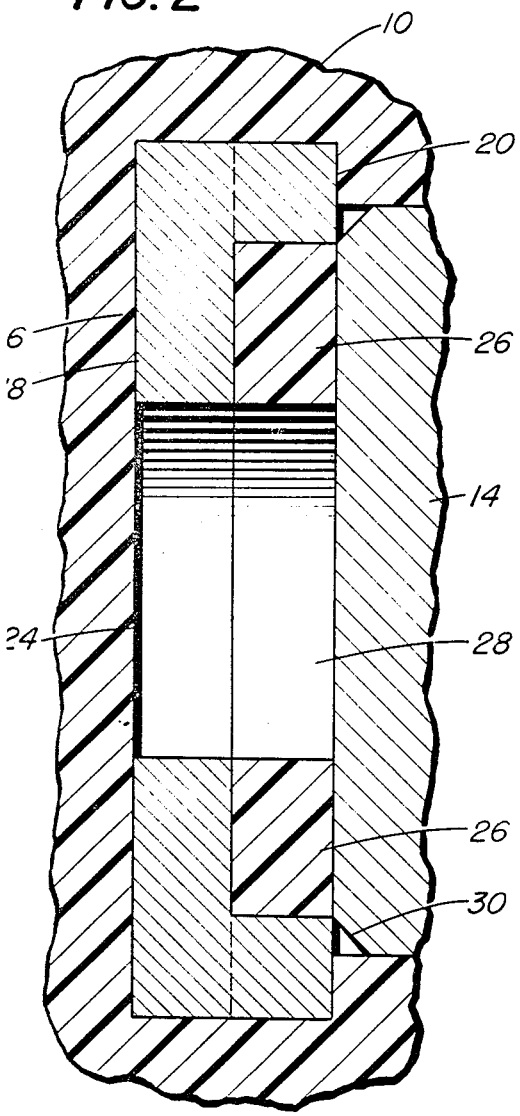
FIG. 3
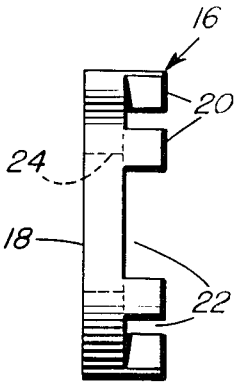
FIG. 4
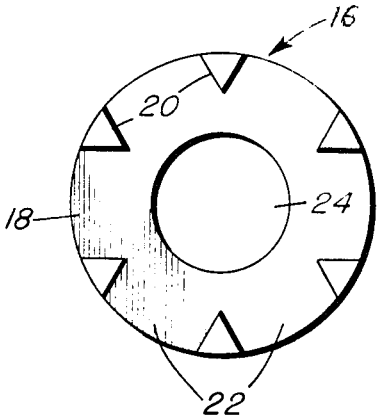
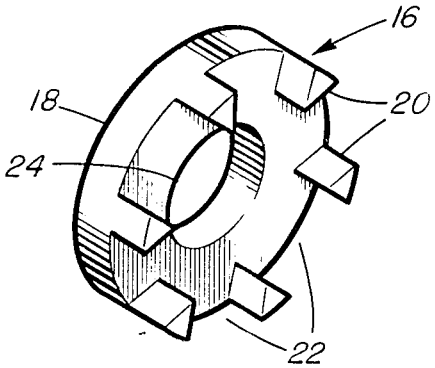
FIG. 5

AREA MULTIPLIER

BACKGROUND AND SUMMARY OF THE INVENTION

The invention described herein may be manufactured, used, and licensed by or for the Government for Governmental purposes without the payment to me of any royalties thereon.

The invention relates to military ordnance and in particular to munitions. Specifically, it relates to sabots for sub-caliber dense metal penetrators.

Saboted sub-caliber dense metal penetrators, when stably launched at a desired velocity level, have demonstrated the capability to produce greatly improved penetration over that of conventional bore-size ammunition. However, difficulties have been encountered in finding materials, suitable for fabrication of a one-piece, homogeneous, plastics sabot, which will consistently provide the required strength, as well as the operational properties that are necessary to achieve design performance levels.

Sabots fabricated from materials which have demonstrated excellent operational properties and characteristics, such as positive uniform separation, stable penetrator launch, and accurate target patterns, could only be launched at less than optimum performance levels. Attempts to achieve the design performance resulted in sabot failures, such as the base end being sheared away.

Conversely, sabots fabricated from materials having sufficient strength to withstand the base loads generated during the launching, exhibited non-uniform and unpredictable separation. The non-uniform and unpredictable separation resulted in large penetrator yaws and poor target patterns.

Although it has been shown that substantial gains in sabot base load performance levels can be achieved through increases in the penetrator diameter, these gains were essentially negated by exterior and terminal ballistic disadvantages of the larger and heavier penetrator. The result has been very little improvement in the effective range.

To overcome the aforementioned problems, the prior art solution has been the development of a sabot having an internal area multiplier built into the sabot structure. The primary object of the prior art area multiplier has been to solve the sabot base failure problem. The base failure problem was caused by the mass of the missile tending to remain at rest as the launch of the sabot, surrounding the missile, was initiated. The base of the sabot in back of the missile simply failed.

The prior art sabot, containing the prior art area multiplier incorporated in the structure, provided a configuration that increased the sabot base strength. The prior art area multiplier provided the sabot base strength benefits of an increased diameter with only a minimal increase in the launched mass. At the same time, this use of this prior art area multiplier in the sabot, permitted the use of a penetrator of optimal design from an exterior and terminal ballistic standpoint. It also retained the operational benefits of sabot material which was otherwise acceptable.

The prior art sabot utilized a flat, disc-like, area multiplier which was molded into a plastics sabot and the missile, or penetrator rests upon the prior art area multiplier when the missile or penetrator was placed in the sabot for launching.

The aforementioned prior art sabot, with the prior art flat, disc-like, area multiplier incorporated in it, produced substantial gains in satisfactory operating pressure of the sabot, with design velocity being achieved without any base failures.

However, the aforementioned prior art sabot with the prior art flat, disc-like, area multiplier incorporated in it, resulted in another problem. The projectile, such as a penetrator, lacked a uniform spin impartment as it was launched, with a resultant degradation in accuracy and terminal effectiveness. Results varied from round to round that were fired.

The aforementioned failure of the prior art sabot, with the prior art area multiplier, regarding uniform spin impartment, is a direct result of the loss of base drive previously provided by engagement of the penetrator and the plastics sabot material and/or rotational slippage of the area multiplier within the sabot. The penetrator tends to initially remain at rest as the sabot begins its spin as it begins the launch. The present invention overcomes these problems.

The present invention provides an area multiplier that increases the operating pressure level of plastics saboted sub-caliber dense metal penetrators while also providing a positive uniform spin impartment. This combined advantage is not reliably obtainable with the prior art area multiplier in plastics sabots. Thus, the present invention eliminates the previously experienced base failure, and also eliminates the rotational slippage of the area multiplier and the rotational slippage of the missile or projectile within the plastics sabot, and provides positive uniform spin impartment to the missile or projectile as it is launched.

The configuration of the present area multiplier of this invention and its incorporation into a plastics sabot is described hereinafter.

It is, therefore, an object of this invention to provide an area multiplier for a sabot that will not rotate within the sabot upon being launched.

It is another object of this invention to provide an area multiplier for a sabot that will lock in place a carried projectile in the sabot so that it will not rotate therein during launching.

It is also an object of this invention to provide an area multiplier for a sabot that will impart a positive uniform spin to a projectile carried in a sabot, at the time of being launched.

It is still another object of this invention to provide an area multiplier for a sabot that will increase the operating pressure level of the sabot.

Further objects and advantages of the invention will become more apparent in light of the following description of the preferred embodiment.

BRIEF DESCRIPTION OF THE DRAWINGS

FIG. 1 is a longitudinal cross-sectional view of a saboted projectile showing a prior art area multiplier within said sabot;

FIG. 2 is an enlarged partial cross-sectional view of a saboted projectile showing an improved area multiplier within said sabot;

FIG. 3 is a side view of the improved area multiplier of FIG. 2;

FIG. 4 is a front view of the improved area multiplier of FIG. 3; and

FIG. 5 is a pictorial perspective view of an improved area multiplier.

DESCRIPTION OF THE PREFERRED EMBODIMENTS

Referring now to the drawings and particularly to FIG. 5, an improved area multiplier is shown at 16. The improved area multiplier 16 is shown in side view in FIG. 3 and in front view in FIG. 4.

A prior art area multiplier 12 is shown in cross-section in FIG. 1 at the base of a missile or projectile 14, such as a dense metal penetrator, encased in a sabot 10. The sabot 10 is shown generally in a cross-sectional view without detailing the structure of the sabot. Such sabots 10 are generally of a plastics material.

As shown in FIG. 1, the prior art area multiplier 12 is flat and disc-like and made of metal, having an aperture therethrough. The prior art area multiplier 12 is circular in configuration with a circular aperture therethrough.

Although the sabot 10, usually of plastics material, is molded around the prior art area multiplier 12, molding techniques generally leave such an insert as the area multiplier 12 without any bond to the plastics material. As a result, the prior art area multiplier 12 has a tendency to slip and rotate within the sabot 10 upon being launched as the sabot begins its initial spin in the barrel of the launching mechanism.

The pocket in the sabot 10 for the missile or projectile 14 is pre-molded and the missile or projectile 14 placed into the pocket when loaded into a launching mechanism for launching. As a result, the missile or projectile 14 has a tendency to rotate within the pocket of the sabot 10 upon being launched as the sabot begins its initial spin in the barrel of the launching mechanism.

The present invention of an improved area multiplier 16 provides restraining means thereon to prevent the aforementioned rotation of the area multiplier and the rotation of the missile or projectile 14. The description of those restraining means is described hereinafter.

Turning now to FIGS. 2, 3, 4, and 5, the improved area multiplier 16 consists of a base means 18, and a plurality of triangular-like projections 20 affixed to said base means 18.

The base means 18 is flat and circular in configuration. The base means 18 has a first face or side, and a second face or side, and an aperture 24 therethrough from said first face or side through said second face or side.

The plurality of triangular-like projections 20 are spaced around the outer periphery of said first face or side of said base means 18, the spacing 22 between each adjacent pair of triangular-like projections 20 providing a means whereby the improved area multiplier 16 is locked to the sabot 10 as hereinafter described.

As can be noted in FIGS. 3, 4, and 5, the triangular-like projections 20 have one side of the triangular-like configuration curved to match and coincide with the peripheral circular edge of the base means 18. Thus, two sides of the projections 20 are straight and one side is curved making the projections 20 triangular-like.

The improved area multiplier 16 is usually of metal and the base means 18 and the affixed triangular-like projections 20 are integral and monolithic with each other in the preferred embodiment.

It is to be understood, however, that the improved area multiplier 16 may be fabricated, cast, or otherwise molded, and may be of any suitable material, with metal as the preferred embodiment, all such variations being within the scope and intent of this invention.

When sabot 10 is manufactured, usually by molding and usually of plastics, the improved area multiplier 16 is molded within the sabot 10 as an insert. A core means is used to form the pocket within the molded sabot for the missile or projectile 14. The core means has a reduced diameter core means end to hold the improved area multiplier 16 in place during the molding operation.

As the material for the sabot 10 flows into the mold it forms around the core means to form the pocket for the missile or projectile 14 and also flows between the triangular-like projections 20 through the spacings or flow-through slots 22 and then around the reduced diameter core means end. As can be seen in FIG. 2 the molding material flowing through the spacings or slots 22 and forming around the reduced diameter core means end forms the extended aperture 28 coinciding with and adjacent to the aperture 24 in the base means 18. At the same time, the material forming the extended aperture 28 concurrently forms the locking bits 26 of material on the first face on side of the base means 18 and around the triangular-like projections 20.

Thus, the improved area multiplier 16 is locked into the sabot 10. The locking bits 26 interfacing with a missile or projectile 14 provide an engagement and support for transmission of thrust and pressure during launching of the missile or projectile 14.

It can be noted in FIG. 2 that the chamfered 30 base of the missile or projectile 14 engages the pointed and sharp apex of the triangular-like projections 20 of the area multiplier. As the sabot 10 is fired or launched the force results in a "set-back" of the missile or projectile 14 so that the chamfer 30 engages the pointed and sharp apex ends of the triangular-like projections 20 in a grip-like hold. Thus, the missile or projectile 14 being in the grip-like hold does not rotate within the sabot 10 and a uniform spin is imparted to the missile or projectile 14 from the spin of the sabot during the launch.

It is to be noted that a circle engaging the aforementioned apex points of the triangular-like projections 20 has a diameter at the points smaller than the diameter of the missile or projectile 14. It is a restricted diameter. The aforementioned "set-back" of the missile or projectile 14 sets the missile or projectile 14 back into the aforementioned restricted diameter, thus providing the plurality of points engagement for the additional spin reliability.

In the drawings six triangular-like projections 20 are shown for illustration. It is to be understood that any plurality of triangular-like projections is within the scope and intent of this invention.

Critical criteria for the improved area multiplier 16 include: an outer diameter sufficient to reduce the sabot 10 material stresses to a level which will preclude base failure; a plurality of raised projections 20 with their inherent spacings therebetween on the first face or side of the base means 18 to permit molding of a base for the missile or projectile 14 and so that the molded material in the spacings locks the improved area multiplier 16 to the sabot 10; and a smaller diameter of a circle engaging the innermost extremities of the raised projections 20 than the outermost diameter of a missile or projectile carried in the sabot 10, to provide multi-point engagement of the missile or projectile during set-back.

As can be readily understood from the foregoing description of the invention, the present structure can be configured in different modes to provide the ability to support a missile or projectile in a a sabot during firing or launching and to prevent the structure and/or the missile or projectile from rotating within the sabot.

Accordingly, modifications and variations to which the invention is susceptible may be practiced without departing from the scope and intent of the appended claims.

I claim:

1. In an improved plastic sabot provided penetrator having an area multiplier, the improvement consisting essentially of an improved area multiplier for use in producing spin to said penetrator coincident with the spin of said sabot during launch, said area multiplier having a disc-like body embedded by molding in said sabot, said body having a peripheral portion provided with a series of projections for engagement with said projectile during launch for uniform spin, and said area multiplier separating from said projectile with the jettison of said sabot from said penetrator subsequent to launch.

2. The sabot provided penetrator of claim 1 wherein said projections are each triangular-like in configuration and in spaced annular relation around the periphery of said area multiplier for separable engagement with said penetrator.

3. The sabot provided penetrator of claim 2 wherein said penetrator has a chamfered edge and said annular projections engage said edge during set-back on launch, and separate from said edge subsequent to launch.

4. The sabot provided penetrator of claim 2 wherein the apices of said triangular-like projections describe a circumference approximating that of said chamfered surface.

* * * * *